US006837222B2

(12) United States Patent
Okazono et al.

(10) Patent No.: US 6,837,222 B2
(45) Date of Patent: Jan. 4, 2005

(54) FUEL SUPPLY APPARATUS

(75) Inventors: Tetsuro Okazono, Okazaki (JP); Mikio Torii, Hekinan (JP); Takashi Koba, Nishikamo-gun (JP); Yoshio Ebihara, Kariya (JP); Masato Inoue, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/654,456

(22) Filed: Sep. 4, 2003

(65) Prior Publication Data

US 2004/0055581 A1 Mar. 25, 2004

(30) Foreign Application Priority Data

Sep. 19, 2002 (JP) ..... 2002-272702
Oct. 21, 2002 (JP) ..... 2002-305530
Jun. 12, 2003 (JP) ..... 2003-167502

(51) Int. Cl.[7] ..... F02M 37/04
(52) U.S. Cl. ..... 123/509
(58) Field of Search ..... 123/509, 497; 417/363; 137/572

(56) References Cited

U.S. PATENT DOCUMENTS 4,651,701 A * 3/1987 Weaver ..... 123/509
4,972,875 A * 11/1990 Beer et al. ..... 137/590
5,272,918 A * 12/1993 Gaston et al. ..... 73/290 R
6,609,503 B1 * 8/2003 Nakagawa et al. ..... 123/509
6,761,193 B1 * 7/2004 Cotton et al. ..... 141/98
2004/0060547 A1 * 4/2004 Aubree et al. ..... 123/497
2004/0168678 A1 * 9/2004 Yamada et al. ..... 123/509

FOREIGN PATENT DOCUMENTS

JP 2000-34960 2/2000

* cited by examiner

*Primary Examiner*—Thomas Moulis
(74) *Attorney, Agent, or Firm*—Nixon & Vanderhye P.C.

(57) ABSTRACT

In a fuel supply apparatus for a vehicle, a sender gauge is attached to a stay separated from a flange and a bracket for supporting a fuel pump. By changing the shape of the stay, without changing the shape of other components, the mounting position of the sender gauge can be arbitrarily defined. The position of the sender gauge can be moved to a position where the interference of a float member with a fuel tank, sub-tank or suction filter may be prevented.

13 Claims, 9 Drawing Sheets

FUEL SUPPLY APPARATUS

CROSS REFERENCE TO RELATED APPLICATION

This application relates to and incorporates herein by reference Japanese Patent Applications No. 2002-272702 filed on Sep. 19, 2002, No. 2002-305530 filed on Oct. 21, 2002 and No. 2003-167502 filed on Jun. 12, 2003.

FIELD OF THE INVENTION

The present invention relates to a fuel supply apparatus of an internal combustion engine.

BACKGROUND OF THE INVENTION

As disclosed in JP-A-2000-34960, a fuel supply apparatus of in-tank type is well known, which places a fuel pump within a fuel tank. In this type of fuel supply apparatus, residual fuel level in a fuel tank is detected by detecting interface of the fuel stored in the fuel tank or a sub-tank contained in the fuel tank. To do this, a fuel supply apparatus has a float member, which floats on the fuel, and a detector for detecting the level of the float member. A detector may be mounted on a lid member for attaching the fuel pump to the fuel tank, a bracket for supporting the fuel pump from the opposite side of the lid member, or a filter case of the fuel pump.

However, since the detector is predetermined to be on a lid member, bracket or fuel pump, mounting position of the detector may not be easily changed. For this reason, depending on the shape of the fuel tank or sub-tank to which a fuel supply apparatus is applied, a float member may interfere with the fuel tank, sub-tank or suction filter for removing foreign substances contained in the fuel. In order to avoid the interference of the float member with the fuel tank, sub-tank or suction filter, a lid member, bracket or fuel pump of different design should be provided for each of shapes of fuel tank to which the fuel supply apparatus is applied. Therefore, it is difficult to standardize the components and design of a fuel supply apparatus.

SUMMARY OF THE INVENTION

It is therefore an object of the present invention to provide a fuel supply apparatus, which allows changing of the mounting position of a detector and standardizing the components and design.

It is another object of the invention to provide a fuel supply apparatus, which allows changing of the mounting position of a detector and easily standardizing the components and design, as well as effectively exploiting any dead space.

It is still another object of the invention to provide a fuel supply apparatus, which may prevent the interference of a float member with a suction filter, sub-tank, and fuel tank, and which may accurately detect the residual fuel level.

According to the present invention, a fuel supply apparatus comprises a fuel pump, a lid member for attaching the fuel pump to the fuel tank, a bracket for supporting the fuel pump from an opposite side of the lid member, a float member and detection means for detecting a residual level of the fuel in the fuel tank.

The apparatus further comprises a support member for mounting the detection means thereon. The support member is formed separately from the lid member and the bracket, and attached detachably to the lid member at one end thereof and to the bracket at another end thereof.

The apparatus further comprises connecting means for connecting the fuel pump to the lid member. The support member is attached detachably to at least one of the lid member and the connecting means.

The apparatus further comprises a sub-tank and a suction filter. The float member is placed between a side wall of the sub-tank in the longitudinal direction of the sub-tank and the suction filter when the fuel level is close to a bottom of the sub-tank.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

[First Embodiment]

Figure 1:
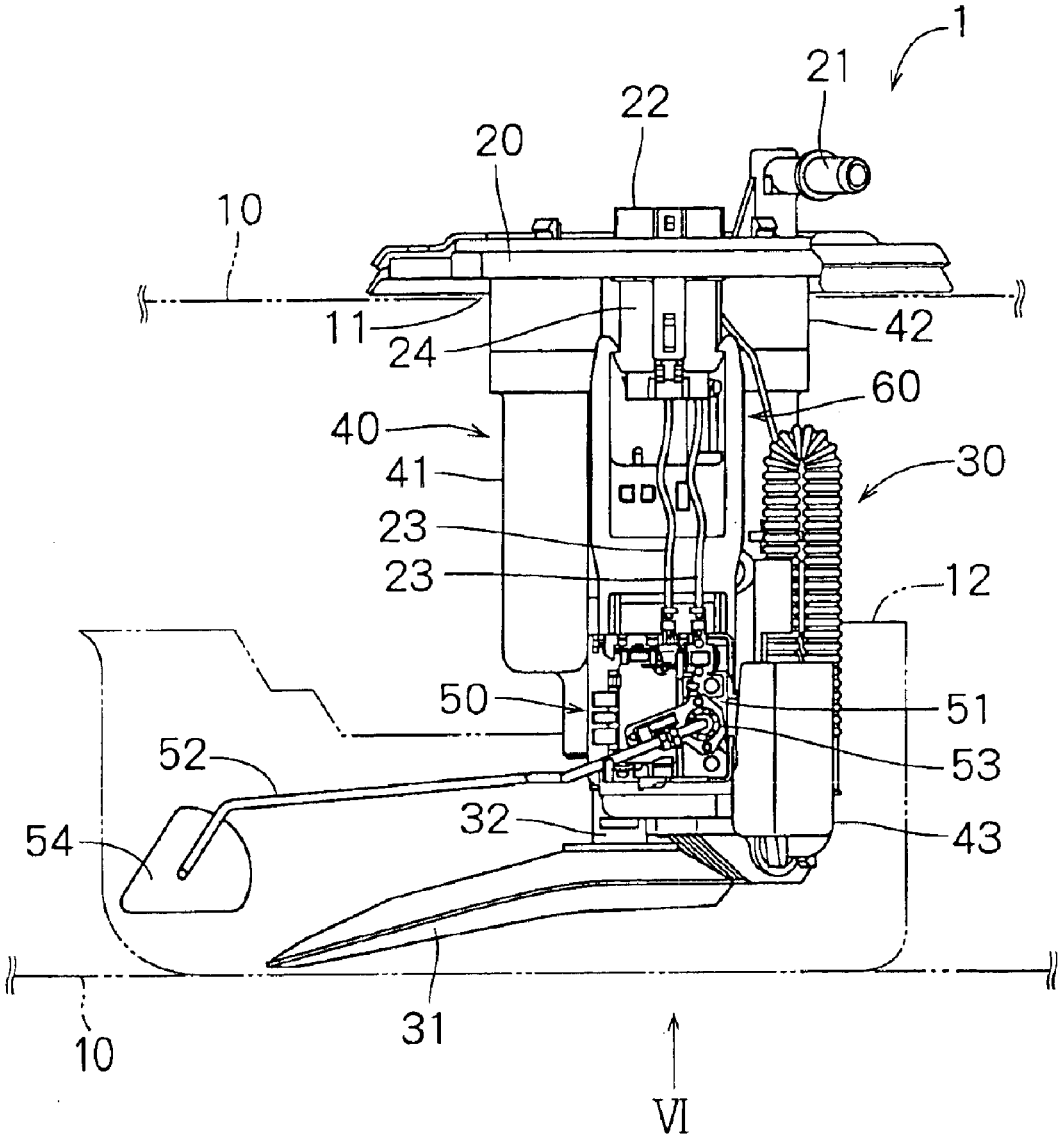
FIG. 1 is a schematic view showing a fuel supply apparatus in accordance with the first embodiment of the invention.

In a fuel supply apparatus 1 shown in FIG. 1 in accordance with the first embodiment of the invention, a fuel tank 10 is formed of metal, and has a circular opening 11 formed at the upper wall. A flange 20 used for a lid member of the fuel supply apparatus 1 is formed in a disk shape, and is attached to the upper wall of the fuel tank 10 by engagement to cover the opening 11. The flange 20 is a part of the fuel tank 10. Any other components except for the flange 20 of the fuel supply apparatus 1 are contained in the fuel tank 10.

To the flange 20 are attached a fuel outlet tube 21 and an electric connector 22. Alternatively, the flange 20, fuel outlet tube 21, electric connector 22 may be integrally formed of resin. The fuel outlet tube 21 is a tube for supplying fuel expelled from a fuel pump 30 and passed through a fuel filter 40 outwardly from the fuel tank 10. The electric connector 22 supplies electric power through a lead 23 to the fuel pump 30, and supplies a residual fuel level signal of a sender gauge 50 used as a fuel detecting means outward of the fuel tank 10 for example to an ECU (not shown).

The sub-tank 12 is contained in the fuel tank 10 and integrally formed of metal. It should be noted here that the fuel tank 10 and the sub-tank 12 might alternatively be made of resin, other than metal. Also, any components such as the fuel pump 30 and fuel filter 40 may be directly assembled onto the fuel tank 10 by omitting the sub-tank 12. The sub-tank 12 may have an opening (not shown) formed so that the fuel in the fuel tank 10 flows in the sub-tank 12 through this opening. In the sub-tank 12, components such as the fuel pump 30, fuel filter 40 and suction filter 31 are contained. The fuel pump 30 may integrally have a fuel filter 40. The fuel filter 40 may capture any foreign substances of relatively small size contained in the fuel expelled from the fuel pump 30, by means of a filter element, which is not shown, and which is contained in a filter case 41. The suction filter 31 is mounted at the fuel inlet 32 positioned on the fuel suction side of the fuel pump 30, and may capture foreign substances of relatively large size contained in the fuel sucked from the sub-tank 12 by the fuel pump 30.

The fuel outlet side of the fuel pump 30 is covered by a housing 42 integrated with the filter case 41. The fuel pump 30 is contained in the sub-tank 12, in the position shown in FIG. 1, with the fuel outlet side to the top in the vertical direction and the fuel inlet side to the bottom in the vertical direction. The fuel pump 30 may have a motor therein, which creates fuel suction force by an impeller revolving with the motor. Fuel expelled from the fuel pump 30 and having any foreign substances filtered out by the fuel filter 40 will be supplied to the engine through the fuel outlet tube 21.

The housing 42 is connected to the flange 20. The housing 42 may be integrally formed of resin with the filter case 41 containing the fuel filter 40, and the fuel pump 30 is contained therein. By attaching the flange 20 to the opening 11 of the fuel tank 10, the fuel pump 30 contained in the housing 42 connected to the flange 20 may be mounted to the fuel tank 10. At the bottom in the vertical direction, i.e., on the fuel inlet side of the housing 42, a bracket 43 is placed. The bracket 43 is attached to the housing 42 for supporting the fuel pump 30 from the opposite side of the flange 20.

Figure 2:
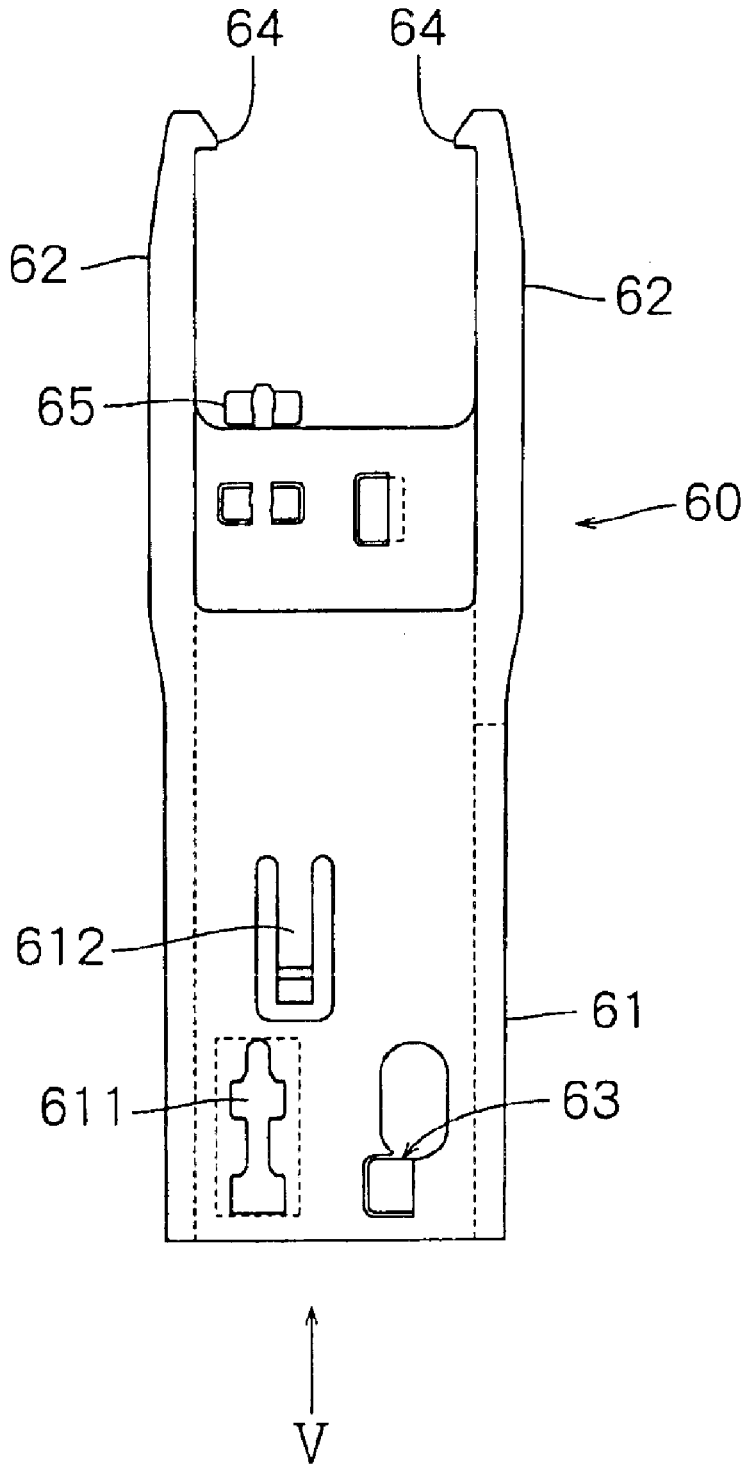
FIG. 2 is a schematic view showing a stay of the fuel supply apparatus in accordance with the first embodiment.

To the flange 20 and bracket 43 is attached a stay 60 as a support member as shown in FIG. 2. The stay 60 may have a fitting 61, arms 62 and an engaging piece 63. The fitting 61 is formed on the face side of the stay 60, i.e., on the side opposing to the fuel tank 10. As shown in FIG. 1, a sender gauge 50 is attached to the fitting 61. The fitting 61 may have a groove 611 for assembling the sender gauge 50, and a detent 612 for holding the sender gauge 50 as shown in FIG. 2.

Figure 3:
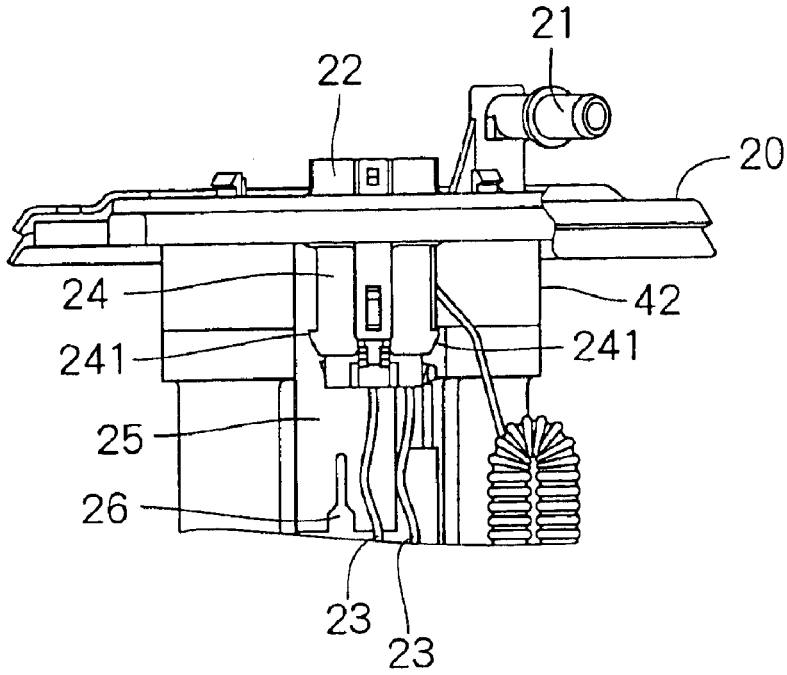
FIG. 3 is a schematic enlarged view of the vicinity of a flange of a fuel supply apparatus in accordance with the first embodiment.
Figure 4:
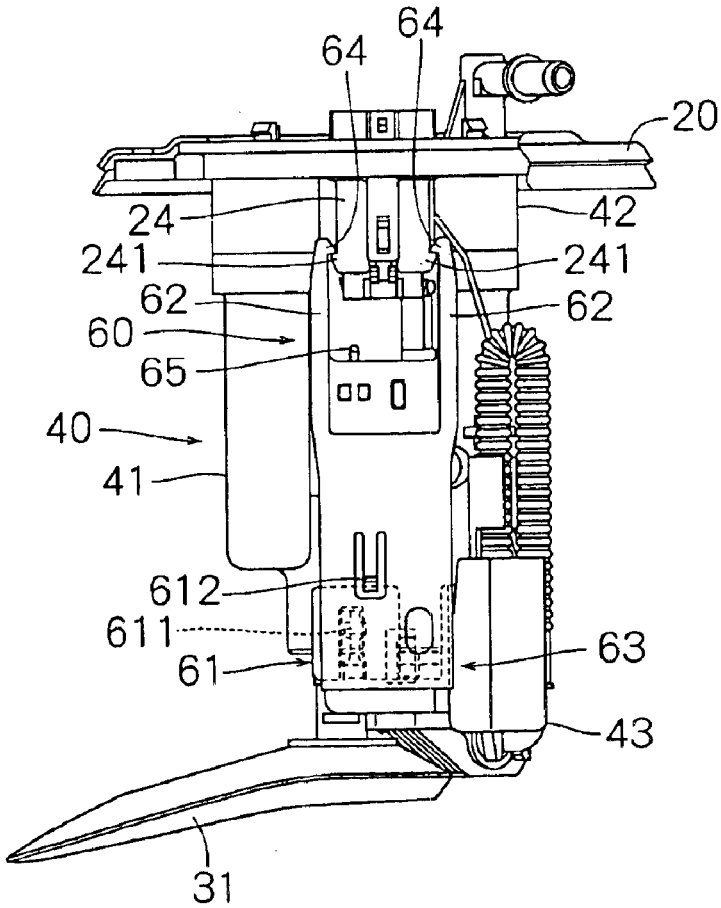
FIG. 4 is a schematic view showing a fuel supply apparatus with a sender gauge removed in accordance with the first embodiment.

The arm 62 is mated to a connector section 24 formed as shown in FIG. 3, extending from the flange 20 into the direction of the bracket 43. The connector section 24 of the flange 20 has a rib 241 projecting into the circumferential direction. As shown in FIG. 2, the stay 60 has detents 64, which engage with the rib 241 of the connector section 24. The detents 64 are formed at the end of the arms 62 opposing to the fitting. In the vicinity of the base of the arms 62 of the stay 60, a T-shape rib 65 is formed projecting from the backside of the stay 60 into the fuel pump 30 side. The T-shape rib 65 shown in FIG. 3 may be engaged with the groove 26 formed on a plate 25 formed extending toward the bracket 43 from the flange 20. By engaging the detents 64 of the stay 60 with the rib 241 of the connector section 24 and by engaging the T-shape rib 65 with the groove 26 of the plate 25, the stay 60 will be secured to the flange 20 as shown in FIG. 4.

Figure 5:
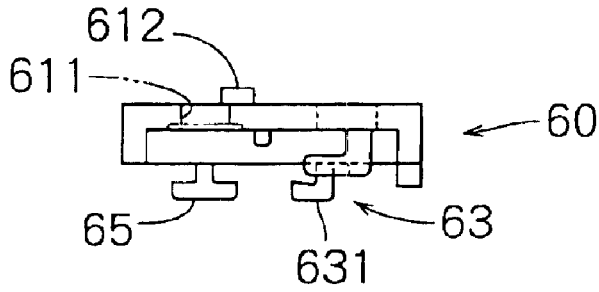
FIG. 5 is a perspective view of the stay of a fuel supply apparatus in accordance with the first embodiment, taken from the position of the arrow V of FIG. 2.
Figure 6:
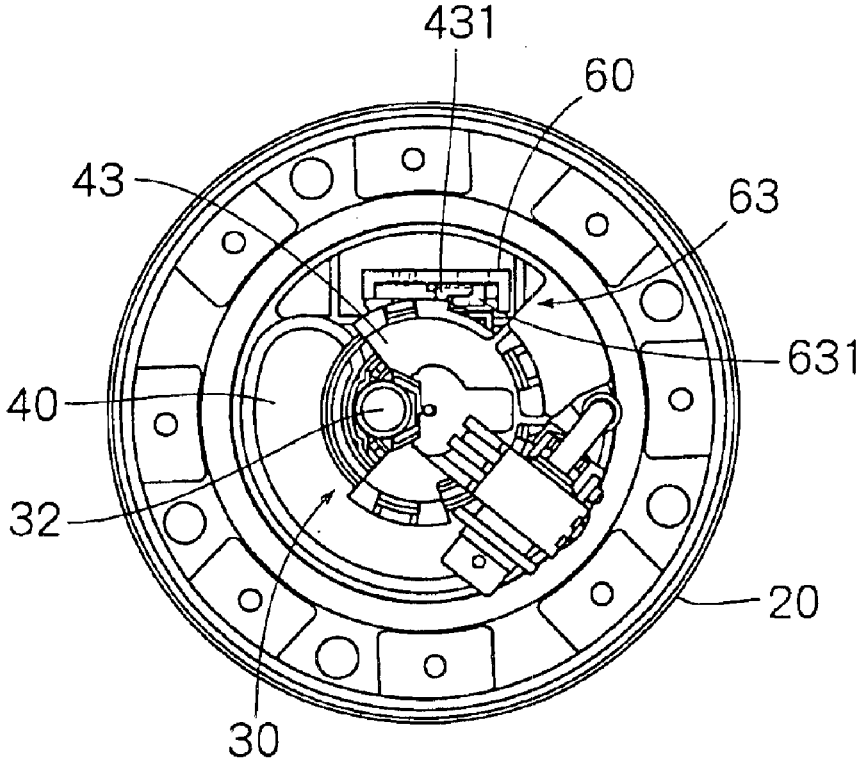
FIG. 6 is a perspective view of a fuel supply apparatus in accordance with the first embodiment, taken from the position of the arrow VI of FIG. 1.

A locking piece 63 is formed on the backside of the stay 60, i.e., on the side facing the fuel pump 30, as shown in FIG. 5. The locking piece 63 has an L-shape rib 631 in a form of letter "L". As shown in FIG. 6, to the bracket 43 is formed a bracket rib 431 of L-shape corresponding to the shape of the L-shape rib 631 of the locking piece 63. The L-shape rib 631 of the locking piece 63 engages with the bracket rib 431 by snap fit to secure the stay 60 to the bracket 43.

The sender gauge 50 shown in FIG. 1 may have a sensor 51, a float arm 52, a support 53, and a float member 54. The sender gauge 50 may be positioned between a suction filter 31 and a fuel filter 40. In the sensor 51 is formed a plurality of electric wirings each having different resistance. The sensor 51 is connected through a lead 23 and an electric connector 22 to an external ECU (not shown). The float arm 52 has the float member 54 at one end, and the other end thereof is supported by the support 53. The displacement of the float member 54 leads to the variation of the float arm 52, causing the support 53 supporting the end of the float arm 52 to be swiveled, resulting in the positional change of contact of the support 53 with the sensor 51. The change of contact position between the support 53 and sensor 51 may be detected as the change of electric resistance in the sensor 51. The electric current value output from the sensor 51 may vary thereby depending on the position of the float member 54 which floats on the fuel, thus the fuel surface level in the fuel tank 10, that is, the residual fuel, may be detected.

The float member 54 is mounted at an end opposite from the support 53 of the float arm 52. The float member 54 may float on the fuel, and moves according to the residual fuel level in the fuel tank 10. Since the float member 54 is supported by the float arm 52, it fluctuates about a pivot center of the support 53.

The sensor 51 has a rib and a fitting (not shown) at the opposite side to the electric wirings, i.e., at the backside of the wirings. The rib may be able to fit with the groove 611 formed on the stay 60 shown in FIG. 2. Also, the fitting may be able to fit with the detent 612 formed on the stay 60 by snap fit. By fitting the rib with the groove 611 and by fitting the fitting with the detent 612 by snap fit, the sensor 51 may be secured to the stay 60, as shown in FIG. 1. By mounting the sensor 51 at the fitting 61 of the stay 60, the sender gauge 50 integrally formed of the sensor 51, float arm 52, support 53 and float member 54 is mounted to the stay 60.

The flange 20 and bracket 43 are attached to the stay 60 as follows.

At first, the T-shape rib 65 of the stay 60 is inserted in the groove 26 of the plate 25 from beneath in FIG. 3. At this time the T-shape rib 65 displaces along with the groove 26 to facilitate the movement of the stay 60 in the vertical direction. Also, the T-shape rib 65 is in contact with the plate 25 to limit the movement of the stay 60 in the direction of depth of the plate 25, i.e., in the direction perpendicular to the drawing plane of FIG. 3. At this time the locking piece 63 is in the vicinity of the bracket 43. In the condition that the T-shape rib 65 of the stay 60 is fitted with the groove 26 of the plate 25, the stay 60 is slid toward the top of FIG. 1, that is, in the direction of the flange 20. This may cause fitting the L-shape rib 631 of the locking piece 63 opposing to the bracket 43 with the bracket rib 431 of the bracket 43, as shown in FIG. 6. By further sliding the stay 60 in the direction toward the flange 20, the detents 64 of the stay 60 will fit to the rib 241 of the connector section 24 by snap fitting. As a result, the stay 60 will be attached to the flange 20 and to the bracket 43, as shown in FIG. 4.

The abutment of the rib 241 of the connector section 24 to the detents 64 of the stay 60 and the clamping force of the arms 62 in the direction toward the connector section 24 will limit the displacement of the stay 60 in the vertical direction of FIG. 1. The displacement of the stay 60 may be further limited in the vertical direction of FIG. 1 by the abutment of an end at the flange 20 side of the groove 26 of the plate 25 to the T-shape rib 65. On the other hand, the abutment of the groove 26 of the plate 25 to the T-shape rib 65 and the engagement of the L-shape rib 631 of the stay 60 with the bracket rib 431 of the bracket 43 will limit the displacement of the stay 60 in the horizontal direction of FIG. 1, that is, in the circumferential direction of the fuel pump 30, as well as the displacement in the cross direction of FIG. 1, that is, radial direction of the fuel pump 30. The stay 60 thereby-will be secured to the flange 20 and the bracket 43.

When the attachment of the stay 60 to the flange 20 and the bracket 43 is completed, the sender gauge 50 may be mounted to the stay 60. The sender gauge 50 will be mounted to the stay 60 by snap fit. Since the stay 60 is secured to the flange 20 and to the bracket 43, its displacement in the vertical, horizontal, and cross directions of FIG. 1 is sufficiently limited to suppress the bump. The accuracy of mounting position of the sender gauge 50 mounted on the stay 60 will be improved along with the bump being suppressed.

In the first embodiment, the sender gauge 50 is mounted to the stay 60, which is separated from the flange 20 and bracket 43. By changing the shape of the stay 60, without changing the shape of any other components of the fuel supply apparatus 1 including the flange 20 and the bracket 43, the mounting position of the sender gauge 50 may be appropriately defined. For example, by changing the length of the arms 62 of the stay 60, or the position and shape of the fitting 61, the mounting position of the sender gauge 50 may be appropriately changed in either vertical, horizontal, or cross direction of FIG. 1. Therefore, the mounting position of the sender gauge 50 may be easily changed without causing a redesign of the flange 20 or the bracket 43.

Also, since redesign of the flange 20 or the bracket 43 is not necessary, the component design of the fuel supply apparatus 1 may be commonly used by changing the shape of the stay 60, even if the shape of the fuel tank 10 or the sub-tank 12 to which the fuel supply apparatus 1 is applied may be different. This allows standardizing the components and design of the fuel supply apparatus 1, and the decrease of the number of components used.

Furthermore, by changing the shape of the stay 60, the mounting position of the sender gauge 50 may be altered and the trajectory of the float member 54 will be changed. Thus the mounting position of the sender gauge 50 may be selected so as not to interfere the float member 54 with the fuel tank 10, sub-tank 12, or suction filter 31. In addition, change of the shape of the suction filter 31 is not required, so that the performance of removing foreign substances and of aspirating fuel is maintained. Moreover, the shape of the suction filter 31 may be simplified.

In the above first embodiment, the sender gauge 50 to the stay 60, and the stay 60 to the flange 20 and the bracket 43 are secured by a fitting such as snap fit. This facilitates attaching and removing of the sender gauge 50 and the stay 60. Therefore the sender gauge 50 and the stay 60 may be readily altered conforming to the shape of the fuel tank 10 to which the fuel supply apparatus 1 is applied.

Also in the above first embodiment, the stay 60 is secured to the flange 20 and the bracket 43. Additionally, a plurality of points may fit the stay 60 to the bracket 43, and the stay 60 to the flange 20. This allows registering the stay 60 in the vertical, horizontal, cross directions of FIG. 11 along with limiting the displacement. Thus the accuracy of mounting position of the sender gauge 50 attached to the stay 60 may be improved as well as the detecting accuracy of the residual fuel level.

[Second Embodiment]

Figure 7:
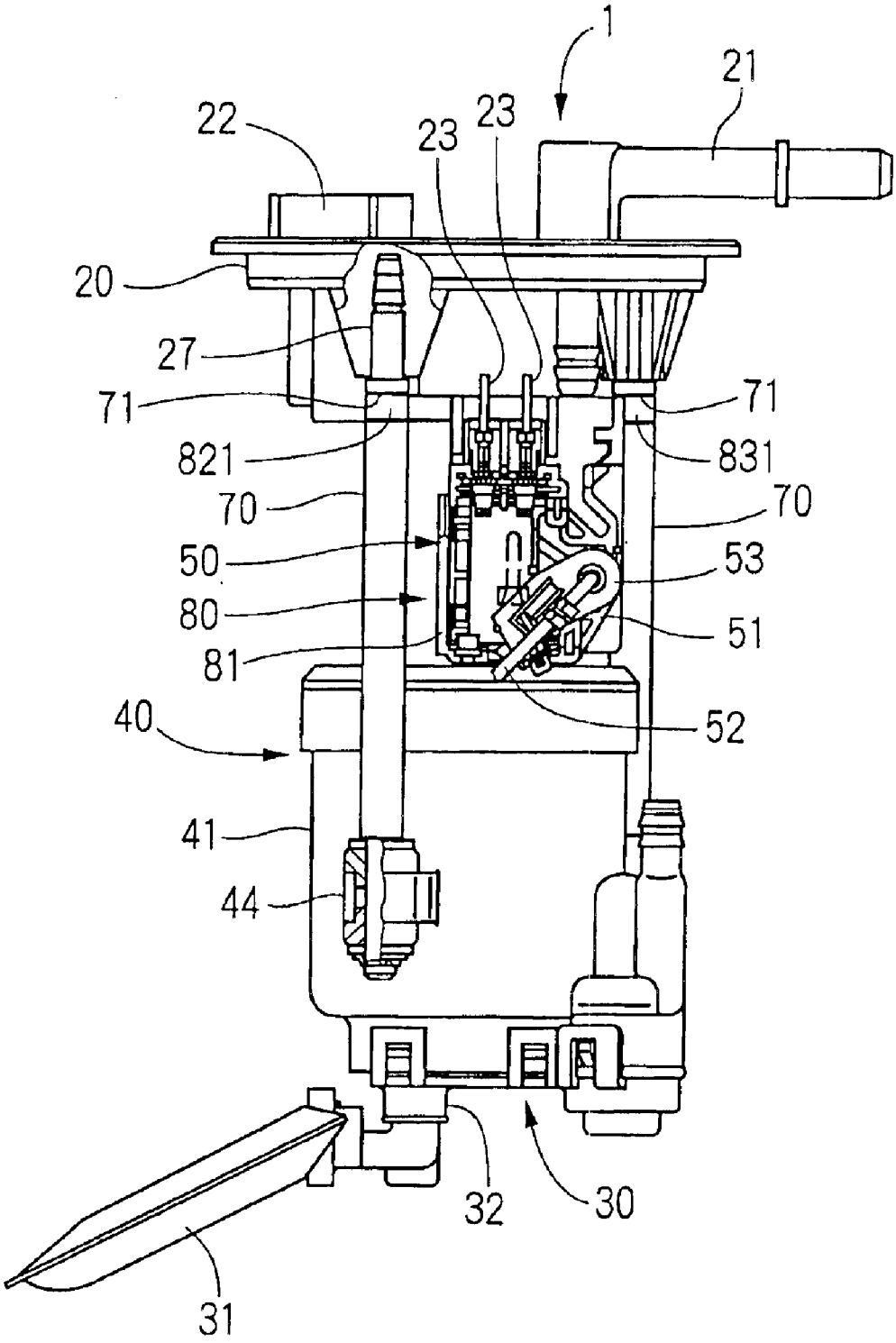
FIG. 7 is a schematic view showing a fuel supply apparatus in accordance with the second embodiment of the invention.
Figure 8A:
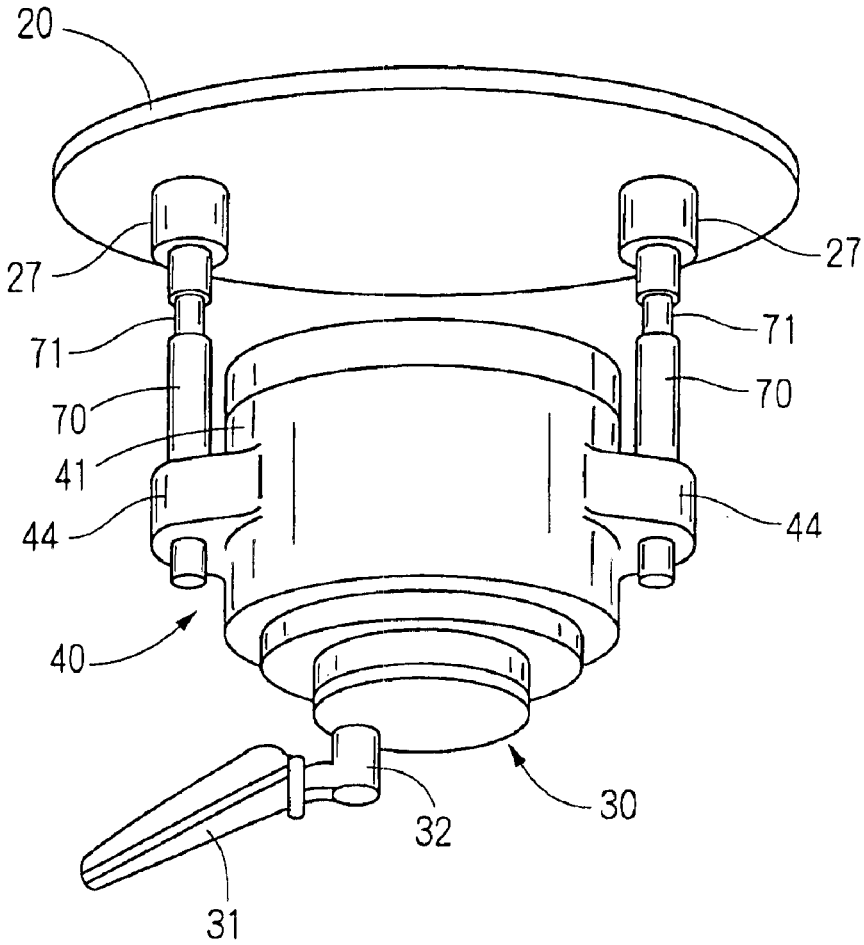
FIG. 8A is a schematic perspective view of a fuel supply apparatus in accordance with the second embodiment, taken from the side of fuel pump.

In a fuel supply apparatus shown in FIG. 7 in accordance with the second embodiment, the fuel pump 30 having the fuel filter 40 and the flange 20 are connected to a shaft 70 used for a connecting member. One end of the shaft 70 is press-fitted into the press fitting 27 of the flange 20, the other end of the shaft 70 is supported by the attachment 44 formed in the filter case 41 of the fuel filter 40. As shown in FIG. 8A, one shaft 70 is placed for each of both ends in the radial direction of the flange 20. Two shafts 70 extend toward the fuel pump 30 from the flange 20. The shaft 70 may be formed of metal such as steel or iron in a cylindrical form. The shaft 70 has a minor diameter section 71 in the mid-stream in the axial direction, which section is smaller in diameter than other part.

Figure 8B:
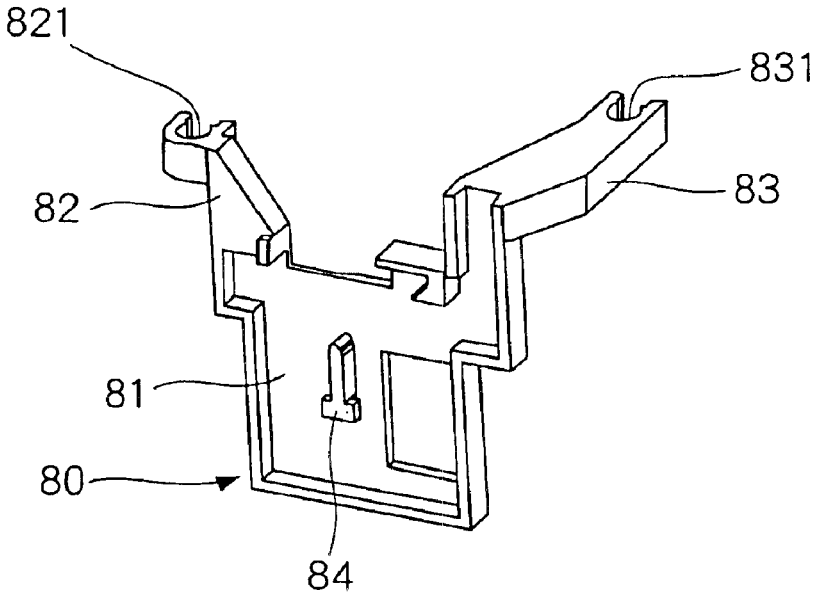
FIG. 8B is a schematic view of a stay of a fuel supply apparatus in accordance with the second embodiment.

As shown in FIG. 7, a stay 80 is attached to the shaft 70. To the stay 80 is mounted the sender gauge 50. The stay 80 has, as shown in FIG. 8B, an attachment base 81, and arms 82, 83. The arm 82 and arm 83 are formed extending from the attachment base 81 toward their corresponding two shafts 70. At the end opposed to the attachment base 81 of the arms 82 and 83, a fitting 821 and a fitting 831 are formed respectively. The attachment base 81 is formed on the face side of the stay 80, that is, on the side facing toward the fuel tank 10. The attachment base 81 has a detent 84 for mounting and holding the sender gauge 50.

The arm 82 and arm 83 are formed projecting inwardly in the circumferential and radial directions of the flange 20 from the attachment base 81. The arm 82 and arm 83 are formed at the end of attachment base 81 in the flange 20 side in the axial direction of the flange 20. At the other ends opposing to the attachment base 81 of the arm 82 and arm 83, fitting 821 and fitting 831 are formed, which are able to fit with the reduced diameter section 71 of the shaft 70.

The stay 80 is made of resin, and the fitting 821 and fitting 831 are resiliently flexible. Thus by pressing the fittings 821 and 831 toward the minor diameter section 71 of the shaft 70, the fittings 821 and 831 may be spread outwardly and fitted on the minor diameter section 71. The stay 80 thereby will be fixed to the shaft 70. Since the fittings 821 and 831 are resiliently flexible, pulling the stay 80 allows facilitating the removal of these fittings 821 and 831 from the minor diameter section 71. Thus, the stay 80 is easily removable from the shaft 70. The length of the shaft 70 in the axial direction of the shaft 70 is made approximately equal to or slightly longer than the length of the fittings 821 and 831 in the axial direction. When the fittings 821 and 831 are fitted on the minor diameter section 71, the fittings 821 and 831 are held on the minor diameter section 71 so that the stay 80 will be limited to displace in the axial direction of the shaft 70. In addition the arm 82 and arm 83 are each extended respectively from the attachment base 81, and each attached to the minor diameter section 71 of the shaft 70. Therefore the stay 80 is held to the shaft 70 at two points.

In this second embodiment, the fittings 821 and 831 of the stay 80 are fitted to the minor diameter section 71 of the shaft 70. This indicates that the mounting position of the stay 80 with respect to the flange 20 and the fuel pump 30 may be definable by the position of the minor diameter section 71 of the shaft 70. That is, by changing the position of the minor diameter section 71 formed on the shaft 70, without redesigning the flange 20, the fuel pump 30, the fuel filter 40 and the stay 80, the mounting position of the stay 80, that is, the position of the sender gauge 50 can be defined. Therefore the mounting position of the sender gauge 50 may be easily changed so as to facilitate standardizing the components and design.

In this second embodiment, the fittings 821 and 831 of the stay 80 are fitted on the minor diameter section 71 of the shaft 70. In addition the stay 80 is held by two shafts 70 at two points. Thus the displacement of the stay 80 in the axial direction of the shaft 70 as well as in the circumferential direction of the flange 20 may be prevented so as to be able to positively hold the stay 80 on the shaft 70.

[Third Embodiment]

Figure 9:
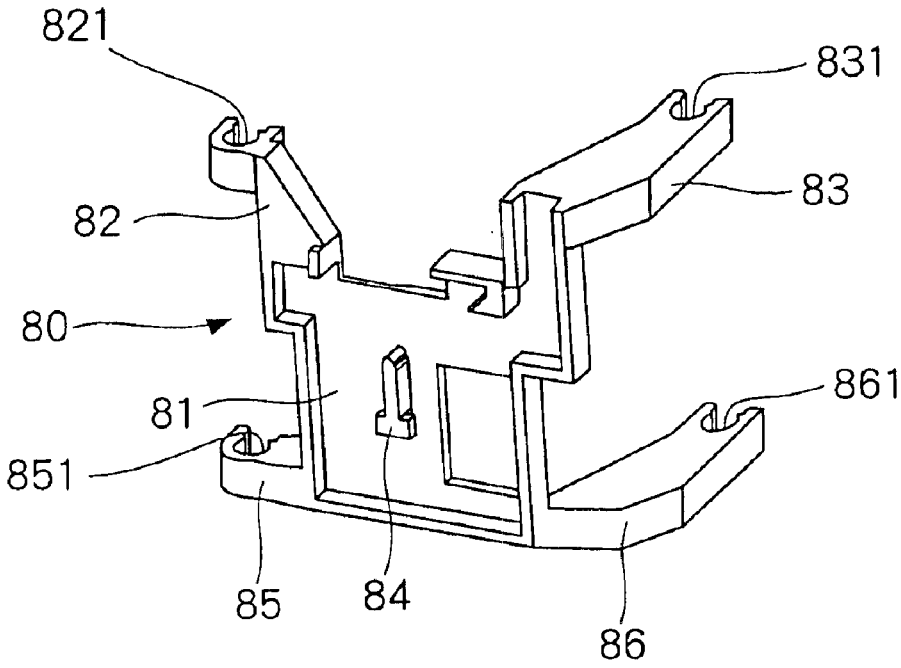
FIG. 9 is a schematic view of a stay of a fuel supply apparatus in accordance with the third embodiment of the invention.

As shown in FIG. 9, the stay 80 has arms 85 and 85 at the end opposite to the flange of the attachment base 81, in addition to the arms 82 and 83 formed at the end toward the flange 20 of the attachment base 81. The arm 85 and arm 86 may have respective fittings 851 and 861 at the end opposed to the attachment base 81, in a similar way to the arm 82 and arm 83. These arms 82 and 85 as well as arms 83 and 86 are formed in an almost same shape.

By forming arms 85 and 86 in addition to the arms 82 and 83 at the attachment base 81, the stay 80 may be held to two shafts 70 at four points. This prevents the stay 80 frog is displacing not only in the circumferential direction of the flange 20 but also in the radial direction of the flange 20. Therefore the stay 80 may be secured to the shaft 70 in a more positive manner.

[Fourth Embodiment]

Figure 10:
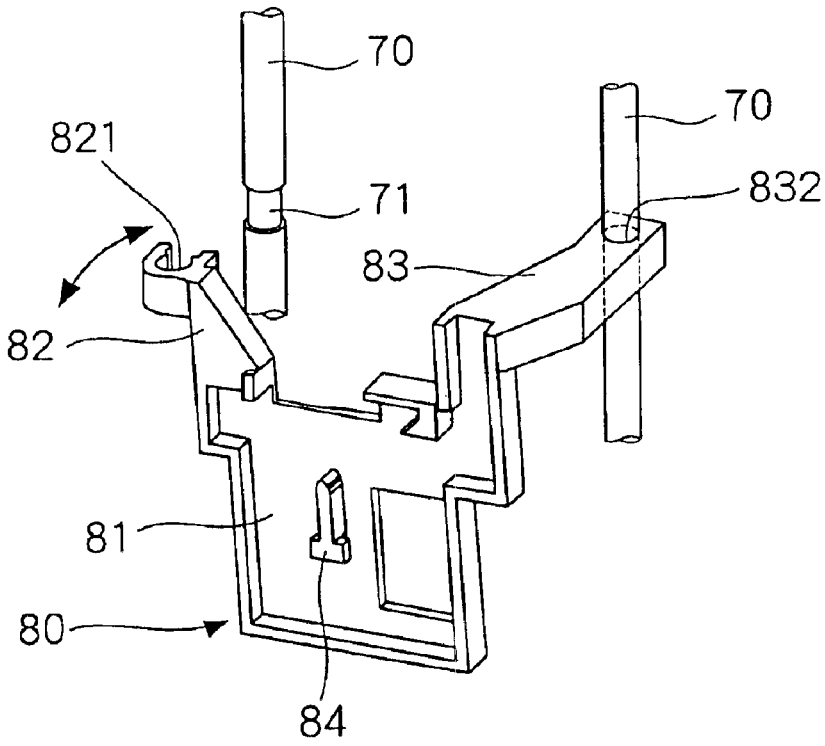
FIG. 10 is a schematic view of a stay of a fuel supply apparatus in accordance with the fourth embodiment.

In the fourth embodiment, as shown in FIG. 10, the stay 80 has a cylindrical section 832 available for the shaft 70 to be inserted, on one arm 83. The cylindrical section 832 is formed at the end of the arm 83 opposite to the attachment base 81. That is, the fitting 821 is formed in one arm 82 extending from the attachment base 81 while the cylindrical section 832 is formed in the other arm 83. Only one of two shafts 70 has the minor diameter section 71 formed thereon. The inner diameter of the cylindrical section 832 is formed approximately equal to or slightly larger than the outer diameter of the shaft 70. This allows the stay 80 to revolve about the shaft 70 inserted to the cylindrical section 832.

When assembling the stay 80 in accordance with the fourth embodiment, one of shafts 70 is inserted first into the cylindrical section 832 of the stay 80. Next, the shaft 70 having the stay 80 attached will be assembled to the flange 20 and to the fuel pump 30. When two shafts 70 are attached to the flange 20 and to the fuel pump 30, one of shafts 70 is inserted into the cylindrical section 832 of the stay 80. For this reason, as shown by the arrow in the figure, the stay 80 may be revolved about the shaft 70 inserted into the cylindrical section 832. Also the stay 80 may be able to displace in the axial direction of the shaft 70. Thereby once the mounting position of the stay 80 in the axial direction of the shaft 70 is determined and by rotating the stay 80 about the shaft 70, the fitting 821 of the stay 80 may correspond to the minor diameter section 71 of the other shaft 70.

At this point by pressing the fitting 821 of the stay 80 toward the minor diameter section 71 of the shaft 70, the fitting 821 will be fitted to the minor diameter section 71. As a result, the stay 80 will be held by two shafts 70 and limited to displace in the circumferential and axial directions of the flange 20. Therefore the stay 80 may be positively held to the shaft 70 while at the same time the displacement of the stay 80 may be prevented.

It should be noted that in the above third embodiment a cylindrical section may be formed on one of arms 70, in a manner similar to that in the above fourth embodiment.

In the second to fourth embodiments, the arms extending from the attachment base of the stay 80 are fitted on two shafts. However, it is possible to form a cylindrical section extending toward the fuel pump 30 on the flange 20 to attach the arms of stay to the cylindrical section of the flange 20. Furthermore, it is also possible to attach one of arms to the cylindrical section extending from the flange 20 and the other arm to the shaft.

In the second through fourth embodiment, the stay 80 is held at two or four points to the shaft 70. However, the stay 80 may be held to the shaft 70 at three or five or more points.

[Fifth Embodiment]

Figure 11:
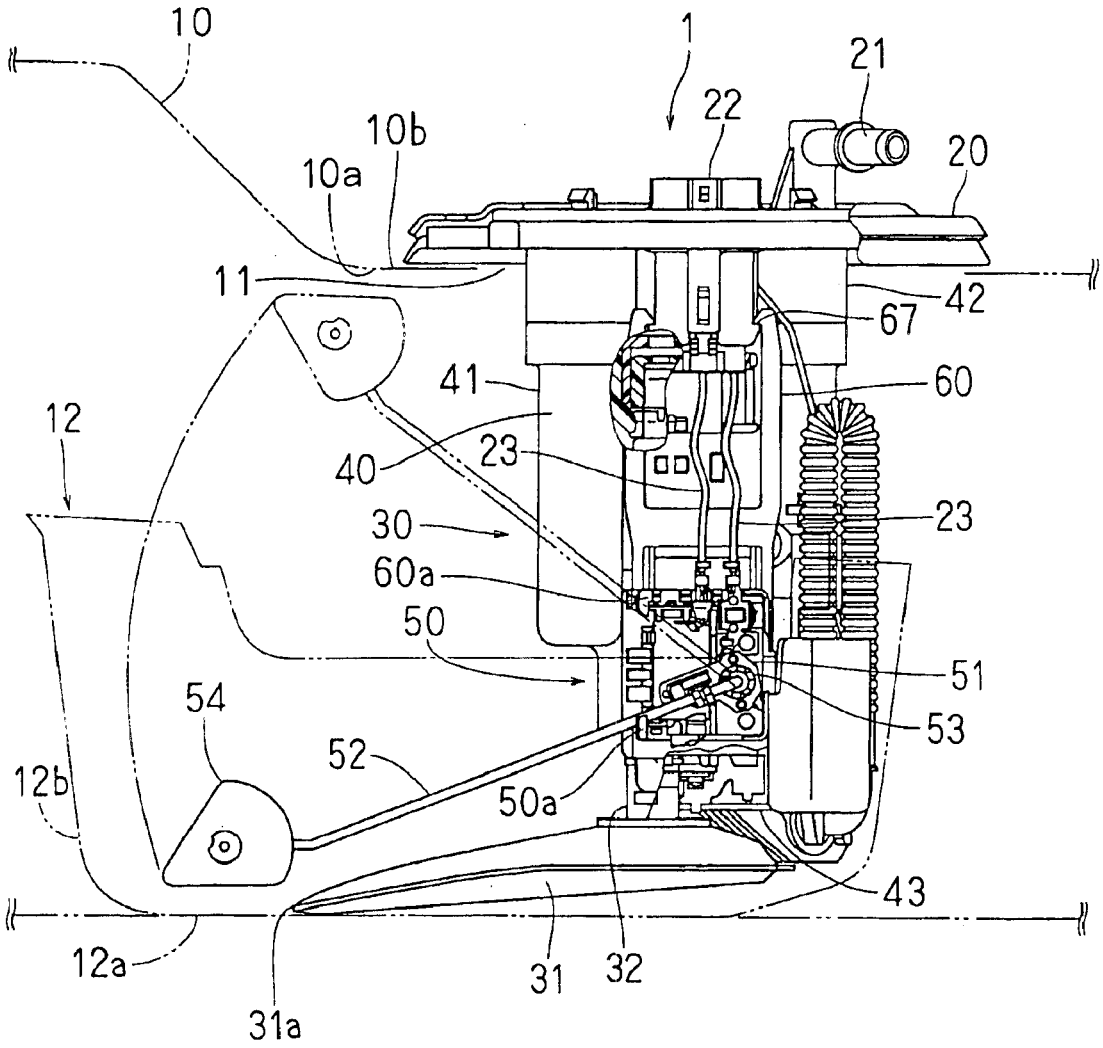
FIG. 11 is a schematic view showing a fuel supply apparatus in accordance with the fifth embodiment of the invention.

In the fifth embodiment of the invention shown in FIG. 11, a fuel tank 10 is made of metal, and a circular opening 11 is formed on an upper wall 10*b*. The upper wall 10*b* of the fuel tank 10 is formed as two levels, and the opening 11 is made on the lower level of those two. A flange 20 as the attachment member of a fuel supply apparatus 1 is made in a disk-shape, the flange 20 covers the opening 11 and is secured to be engaged by the upper wall 10*b* of the fuel tank 10. The flange 20 constitutes a part of the fuel tank 10. Any components other than the flange 20 of the fuel supply apparatus 1 are contained in the fuel tank 10.

To the flange 20 are attached a fuel outlet tube 21 and an electric connector 22. The flange 20, fuel outlet tube 21, electric connector 22 may be integrally formed of resin. The fuel outlet tube 21 is a tube for supplying fuel expelled from a fuel pump 30 contained within a sub-tank 12 and passed through a fuel filter 40 outwardly from the fuel tank 10. The electric connector 22 supplies electric power through a lead (not shown) to the fuel pump 30, and also supplies the residual fuel level signal of a sender gauge 50 outward of the fuel tank 10.

The sub-tank 12 is contained in the fuel tank 10 and having a bottom 12*a* and a sidewall 12*b* integrally formed of metal. It should be noted that the fuel tank 10 and the sub-tank 12 might alternatively be made of resin, instead of metal. The sub-tank 12 may have an opening (not shown) formed so as for the fuel in the fuel tank 10 to flow into the sub-tank 12 through this opening. In the sub-tank 12 components such as the fuel pump 30, fuel filter 40, and suction filter 31 are housed. The fuel filter 40 may capture any foreign substances of relatively small size contained in the fuel expelled from the fuel pump 30, by means of a filter element, which is not shown, and which is contained in a filter case 41. The center of the sub-tank 12 is eccentrically arranged from the center of the opening 11 of the fuel tank 10. The suction filter 31 is mounted at the fuel inlet 32 positioned on the fuel suction side of the fuel pump 30, and-may capture foreign substances of relatively large size contained in the fuel sucked from the sub-tank 12 by the fuel pump 30. The suction filter 31 is placed at the bottom 12*a* side of the sub-tank 12.

The fuel outlet side of the fuel pump 30 is covered by a housing 42 integrated to a filter case 41. The fuel pump 30 is contained in the sub-tank 12, in the position shown in FIG. 11, with the fuel outlet side to the top in the vertical direction and the fuel inlet side to the bottom in the vertical direction. The fuel pump 30 may have a motor not shown therein, which creates fuel suction force by an impeller revolving along with the motor. Fuel expelled from the fuel pump 30 and having any foreign substances filtered out by the fuel filter 40 will be supplied to the engine through the fuel outlet tube 21.

The housing 42 is connected to the flange 20. The housing 42 may be integrally formed of resin with the filter case 41 containing a fuel filter 40, and the fuel pump 30 is contained therein. By attaching the flange 20 to the opening 11 of the fuel tank 10, the fuel pump 30 contained in the housing 42 connected to the flange 20 may be mounted to the fuel tank 10. At the bottom in the vertical direction, i.e., on the fuel inlet side of the housing 42, a bracket 43 is placed. The bracket 43 is attached to the housing 42, for supporting the fuel pump 30 from the opposite side of the flange 20.

Figure 12:
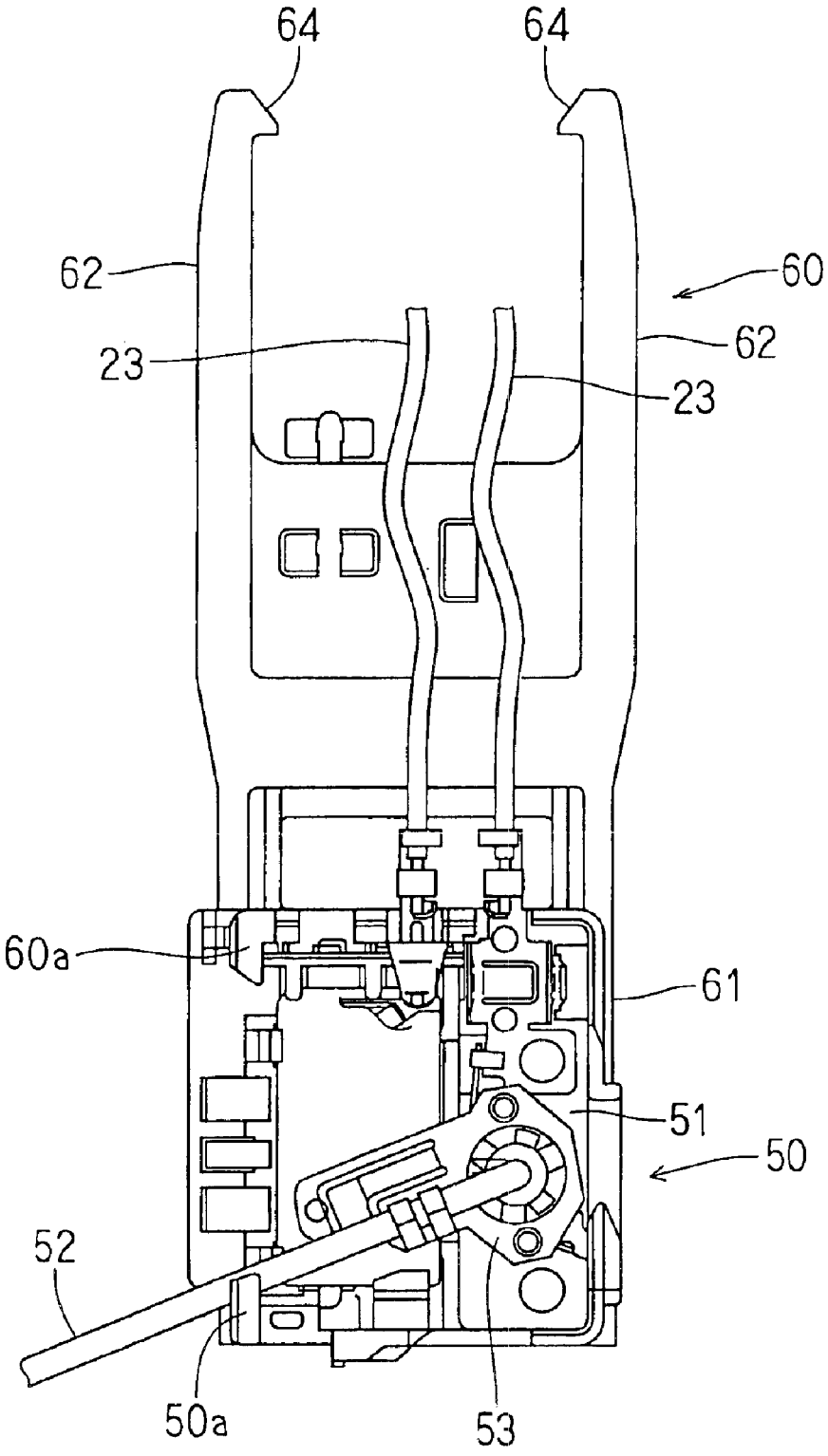
FIG. 12 is a schematic view showing a stay of the fuel supply apparatus in accordance with the fifth embodiment.

To the flange 20 a stay 60 is attached as a support member. The stay 60 may have a fitting 61 and arm 62 as shown in FIG. 12. At the tip of the arm 62 of the stay 60 is formed a detent 64, which is fitted to a step 67 formed on the flange 20 shown in FIG. 11. By fitting the detent 64 with the step 67, the stay 60 will be engaged with the flange 20 by snap fit. The stay 60 is formed extending from the flange 20 toward the suction filter 31. At the fitting 61 in an end of the stay 60 in the suction filter 31 side, a sender gauge 50 is placed, as shown in FIG. 12.

The sender gauge 50 may have a sensor 51, a float arm 52, and a support 53. The sender gauge 50 may be positioned between a suction filter 31 and a fuel filter 40. In the sensor 51 is formed a plurality of electric wirings each having different resistance. The sensor 51 is connected through a lead 23 and a connector 22 to an external ECU (not shown). The float arm 52 has a float member 54 at one end as shown in FIG. 11, and the other end thereof is supported by the support 53. The float arm 52 is formed approximately linearly connecting the support 53 to the float member 54 without being bent in the midstream.

The support 53 supports the float arm 52 in a fluctuatable manner. The displacement of the float member 54 leads to the fluctuation of the float arm 52, causing the support 53 supporting the end of the float arm 52 to be swiveled, resulting in the positional change of contact of the support 53 with the sensor 51. The change of contact position between the support 53 and sensor 51 may be detected as the change of electric resistance in the sensor 51. The electric current value output from the sensor 51 may vary thereby depending on the position of the float member 54, which floats on the fuel, thus the fuel surface level in the fuel tank 10 or that is, the residual fuel may be detected.

The float member 54 is mounted at an end opposing to the support 53 of the float arm 52. The float member 54 may float on the fuel surface, and moves according to the residual fuel level in the fuel tank 10. Since the float member 54 is supported by the float arm 52, it fluctuates about a pivot center of the support 53. The sender gauge 50 has an arm 50*a* formed, and the displacement of the float arm 52 is limited by the abutment of the float arm 52 with the arm 50*a*.

Also, the float member 54 is placed between the suction filter 31 and the sidewall 12*b* of the sub-tank 12 along with the eccentric direction between the center of the sub-tank 12 and the center of opening 11. That is, a virtual straight line connecting the center of the sub-tank 12 to the center of the opening 11 may be approximately in parallel to another virtual straight line connecting the side wall 12*b* of the sub-tank 12 and the suction filter 31 to the float member 54. In addition, the virtual straight line connecting the side wall 12*b* of the sub-tank 12 and the suction filter 31 to the float member 54 may be approximately in parallel to the longitudinal direction of the sub-tank 1 and the suction filter 31.

When the amount of residual fuel in the fuel tank 10 becomes low, the float member 54 attached at the end of the float arm 52 will move toward the bottom 12*a* side of the sub-tank 12. Then, if the float arm 52 abuts the arm 50*a*, the displacement of the float arm 52 will be restricted so that the float member 54 will not abut to the bottom 12*a*.

The sender gauge 50 is placed on the stay 60. Thus the position of the support 53 that may become the center of swivel of the float member 54 will change along with the sender gauge 50 by changing the length in the vertical direction of FIG. 12 of the stay 60. That is, by changing the length of the stay 60 the swivel center of the float member 54 will be freely changed.

When the residual fuel level in the fuel tank 10 is low, the fuel surface level in the sub-tank 12 is in the vicinity of the bottom 12*a* of the sub-tank 12. Since the displacement of the float arm 52 is restricted by the arm 50*a*, the float member 54 will not abut the bottom 12*a* of the sub-tank 12 and the suction filter 31. At this point, the float member 54 will be positioned between the end 31*a* of the suction filter 31 in the side opposite to the fuel pump and the sidewall 12*b* of the sub-tank 12.

Along with the increase of the residual fuel level in the fuel tank 10, the fuel surface level within the sub-tank 12 will be raised in the direction of the upper wall 10*b* of the fuel tank 10. At this point the float member 54 will move in the direction of the upper wall 10*b*, swiveling about the support 53 without contacting the side wall 12*b* of the sub-tank 12. Thereafter, when the fuel tank 10 is almost filled with fuel, that is, when the fuel surface level reaches the inner wall surface 10*a* of the upper wall 10*b* of the bottom, the float member 54 will be restricted to move by the float arm 52 abutting the arm 60*a*. On the other hand, when the fuel in the fuel tank 10 decreases, contrary to the above description, the float member 54 will move from the upper wall 10*b* side of the fuel tank 10 toward the bottom 12*a* of the sub-tank 12 by swiveling about the support 53.

In this preferred embodiment, the support 53, which is the swivel center of the float member 54, is positioned between the suction filter 31 and the fuel filter 40. For this reason, both during the displacement of the float member 54 from the bottom 12*a* of the sub-tank 12 to the upper wall 10*b* of the fuel tank 10, or during the displacement from the upper wall 10*b* of the fuel tank 10 to the bottom 12*a* of the sub-tank 12, the float member 54 will not contact the sub-tank 12 or suction filter 31. Thus it is not necessary to extend the float arm 52 in order to prevent the interference of the float member 54 with the suction filter 31, and the interference of the float member 54 with the side wall 12*b* of the sub-tank 12 due to the extended float arm 52 will also be prevented.

In accordance with the fuel supply apparatus 1 according to the fifth embodiment, by mounting the sender gauge 50 on the stay 60 extending from the flange 20 toward the suction filter 31, the mounting position of the sender gauge 50 may be freely definable, in correspondence with the length of the stay 60. Therefore the position of the support 53 for supporting the float member 54 along with the float arm 52 may be defined arbitrarily. This allows the moving path of the float member 54 to be changed freely without changing the shape of the fuel tank 10, sub-tank 12, and suction filter 31. Accordingly, the float member 54 may be readily placed at a given position so as not to interfere with the suction filter 31 and sub-tank 12, so as to improve the detection accuracy of the residual fuel level.

In this embodiment, the swiveling center of the float member 54 is positioned between the suction filter 31 and the fuel filter 40. The support 53, which is the swiveling center of the float member 54, will be positioned in the vicinity of the suction filter 31 rather than the fuel filter 40. As a result, the movable range of the float member 54 attached to the float arm 52 will be enlarged. The float member 54 thereby will not interfere with the suction filter 31, sub-tank 12 and fuel tank 10 during the displacement from the bottom 12*a* to the upper wall 10. Accordingly, the movement of the float member 54 can follow smoothly the fuel surface level.

In addition, the sender gauge 50 is mounted on a stay 60 separated from the flange 20. By adjusting for example the length of the arm 62, the total length of the stay 60 will be altered, so that the swivel center of the float member 54 will be readily changed. For example, the fuel tank 10 to which the fuel supply apparatus 1 is applied may have different shape of depths depending on the model of vehicle. In such a situation, changing the length of the stay 60 allows the swivel center of the float member 54 to be redefined in conformity with the shape of the fuel tank 10, without changing fundamental structure of the fuel supply apparatus 1.

In the fifth embodiment, the position of the swivel center of float member 54 is altered by attaching the sender gauge 50 to the stay 60, and changing the total length of the stay 60. However, it is possible that the sender gauge 50 is mounted at a given position of the bracket 43 so that the swivel center of the float member 54 will be arbitrarily altered. Further, the stay 60 may be constructed as in the first to fourth embodiments.

The present invention should not be limited to the above disclosed embodiments, but may be modified in various other ways without departing from the spirit of the invention.

What is claimed is:

1. A fuel supply apparatus comprising:

a fuel pump for discharging fuel from a fuel tank;

a lid member for attaching the fuel pump to an upper wall of the fuel tank;

a bracket for supporting the fuel pump from an opposite side of the lid member;

a float member which floats on the fuel stored in the fuel tank;

a detection means for detecting a residual level of the fuel in the fuel tank from a position of the float member; and a support member for mounting the detection means thereon, the support member being formed separately from the lid member and the bracket, and attached detachably to the lid member at one end thereof and to the bracket at another end thereof.

2. The fuel supply apparatus according to claim 1, wherein the support member fits with the lid member and the bracket.

3. The fuel supply apparatus according to claim 2, wherein the support member is snap-fit to the lid member and the bracket.

4. A fuel supply apparatus comprising:

a fuel pump for discharging fuel from a fuel tank;

a lid member for attaching the fuel pump to an upper wall of the fuel tank;

a connecting means for connecting the fuel pump to the lid member;

a float member which floats on the fuel stored in the fuel tank;

a detection means for detecting a residual level of the fuel in the fuel tank from a position of the float member; and a support member for mounting the detection means thereon, the support member being formed separately from the lid member and the fuel pump, and attached detachably to at least one of the lid member and the connecting means.

5. The fuel supply apparatus according to claim 4, wherein the connecting means includes two connecting members, and the support member has at least two arms connected to the connecting members.

6. The fuel supply apparatus according to claim 5, wherein the arms have fittings available to fit with reduced diameter sections of the connecting members.

7. The fuel supply apparatus according to claim 4, wherein the support member has one side attached to the lid member and another side attached to the connecting means.

8. The fuel supply apparatus according to claim 1, further comprising:

a sub-tank contained in the fuel tank; and a suction filter mounted at an fuel inlet of the fuel pump in the sub-tank for filtering out foreign matters contained in the fuel, wherein the float member is placed between a side wall of the sub-tank in a longitudinal direction of the sub-tank and the suction filter when the fuel level is close to a bottom of the sub-tank.

9. The fuel supply apparatus according to claim 8, wherein the detection means has an approximately linear float arm for supporting the float member.

10. The fuel supply apparatus according to claim 8, wherein a center of the sub-tank is eccentric from a center of an opening of the fuel tank to which the attachment member is attached, and the float member is placed along with the eccentric direction from the center of the sub-tank to the center of the opening and in between the suction filter and the side wall of the sub-tank.

11. The fuel supply apparatus according to claim 4, further comprising:

a sub-tank contained in the fuel tank; and a suction filter mounted at an fuel inlet of the fuel pump in the sub-tank for filtering out foreign matters contained in the fuel, wherein the float member is placed between a side wall of the sub-tank in a longitudinal direction of the sub-tank and the suction filter when the fuel level is close to a bottom of the sub-tank.

12. The fuel supply apparatus according to claim 11, wherein the detection means has an approximately linear float arm for supporting the float member.

13. The fuel supply apparatus according to claim 11, wherein a center of the sub-tank is eccentric from a center of an opening of the fuel tank to which the attachment member is attached, and the float member is placed along with the eccentric direction from the center of the sub-tank to the center of the opening and in between the suction filter and the side wall of the sub-tank.

* * * * *